US009248892B1

(12) United States Patent
Young et al.

(10) Patent No.: US 9,248,892 B1
(45) Date of Patent: Feb. 2, 2016

(54) STABILIZING FIN FOR A WATER PLANING DEVICE

(71) Applicants: Todd Young, Oxnard, CA (US); Stephen Daniel Upham, Oxnard, CA (US)

(72) Inventors: Todd Young, Oxnard, CA (US); Stephen Daniel Upham, Oxnard, CA (US)

( * ) Notice: Subject to any disclaimer, the term of this patent is extended or adjusted under 35 U.S.C. 154(b) by 0 days.

(21) Appl. No.: 14/320,931

(22) Filed: Jul. 1, 2014

Related U.S. Application Data

(60) Provisional application No. 61/841,886, filed on Jul. 1, 2013.

(51) Int. Cl.
*B63B 39/00* (2006.01)
*B63B 39/06* (2006.01)

(52) U.S. Cl.
CPC ..... *B63B 39/00* (2013.01); *B63B 39/06* (2013.01); *B63B 2221/00* (2013.01)

(58) Field of Classification Search
CPC .... B63B 39/06; B63B 35/7926; B63B 35/81; B63B 35/73; B63B 1/00
USPC ..... 114/126, 39.12, 39.15; 441/79, 74
See application file for complete search history.

(56) References Cited

U.S. PATENT DOCUMENTS

| | | | | |
|---|---|---|---|---|
| D194,171 | S | 11/1962 | Senne | |
| 3,089,157 | A | 5/1963 | May | |
| 3,103,673 | A * | 9/1963 | Martin, Jr. | 441/79 |
| D271,318 | S | 11/1983 | Hope | |
| D343,437 | S | 1/1994 | De Paoli | |
| 6,089,935 | A * | 7/2000 | Fleming, III | 441/79 |
| 6,106,346 | A | 8/2000 | Bolen | |
| 6,217,402 | B1 | 4/2001 | Bolen | |
| 6,379,204 | B2 | 4/2002 | Bolen | |
| 6,767,266 | B2 | 7/2004 | Bolen | |
| 6,955,577 | B1 | 10/2005 | Hall | |
| 2001/0006864 | A1 | 7/2001 | Bolen | |

* cited by examiner

*Primary Examiner* — Lars A Olson
(74) *Attorney, Agent, or Firm* — Sandy Lipkin

(57) ABSTRACT

A stabilizing fin that includes a hollow tubular element that has an upper surface for attachment to the bottom surface of a water planing device. The tubular element has an open front end and open rear end. During use thereof the hollow tubular element provides lateral stability and vertical stability while allowing for increased turning ability for enhanced control by a user. The water planing device may be, for example, a surfboard, a wind surfing board, a kite board, a water ski, a wake board or a boat.

2 Claims, 7 Drawing Sheets

STABILIZING FIN FOR A WATER PLANING DEVICE

REFERENCE TO PRIOR APPLICATION

This application claims priority of the provisional patent application 61/841,886, filed Jul. 1, 2013 entitled STABILIZING FIN FOR A WATER PLANING DEVICE by Stephen Upham.

BACKGROUND OF THE INVENTION

1. Field of the Invention

The field of this invention relates generally to the field of fins for water craft and more particularly toward a fin or keel that stabilizes a surfboard or other water craft laterally, vertically. The primary purpose of the instant invention is the stabilization of a surfboard or other water craft where the intended craft direction, wave direction and hydraulic lift form a critical nexus of conditions which are to be controlled and maneuvered when operating the water craft.

2. Description of the Prior Art

There are many different types of stabilizing fins and keels or rudders on the market. The present invention seeks to offer greater control in a wider range of conditions than those currently found on the market. When maneuvering water planing devices it is beneficial to utilize a steering mechanism of some sort. Traditional methods of maneuvering and steering water craft typically involve a propulsion system and a steering system. The steering system benefits from physical engineering aspects, such as the manipulation and control of vertical lift and horizontal tracking combined with craft characteristics that effect aspects of control, such as buoyancy, rail or edge shape and bottom aspects like rocker, flat, concave or convex attributes.

Some water crafts achieve propulsion from a pull type propulsion force. Sail boarding, sailing, wakeboarding, water skiing, wind surfing and kite surfing are examples of this). Other water crafts utilize push type propulsion forces. Surfing and motor boating on waves are examples of this. Each type of propulsion system benefits from different combinations of craft and fin, or keel characteristics that work together to achieve the most desirable maneuverability. Craft speed and direction in relation to the propulsion direction combine with occupant weighting to the fore, or aft, left (starboard) and right (port) as well as relative pitch or angle on the water surface provide necessary inputs to optimal craft and occupant ride. The maneuverability of water craft depends on the direction of propulsion, the force of propulsion, the plane of the water surface, the pitch and direction of water craft, i.e., the edges, bottom profile, rocker and keel/rudder/fin.

The instant invention seeks as its primarily application for use on surfboards and high performance windsurfing boards. However, it is understood that it can be used on any water planing water craft or device. Persons who engage in floating and sliding water sports seek maximum control over their craft in a variety of conditions. Surfboards, of all of the common types of water craft, operate in the most dynamic and rigorous conditions. Accordingly, for illustration purposes, this application will be directed by way of example to the dynamics of steering a surfboard in the most critical of conditions, i.e., slow and mushy or hollow and fast waves. Nonetheless, the benefits described herein apply to different effect to all other water craft.

Three primary attributes that traditional steering mechanisms for water craft focus on are drag, stall and lift. Stall is a commonly used term in surfing and windsurfing where the rider of the water craft wishes to significantly alter the course of their water craft and a condition exists where there is not enough momentum and leverage to complete the desired course correction. Stall often ends the ride on the wave via the wave continuing on with the rider falling into the water, or otherwise impairs an ideal ride on the wave. Stall can also have other and very dangerous consequences for riders. Stall can be used to describe the situation where a water craft's momentum down the face of a wave is overcome by significant upward thrust of waves, called hydraulic lift. When the forward momentum is overcome by the force of the hydraulic lift and stall occurs, it can send the board reeling in the circular path of the dominant force of the wave as it crests and breaks. A rider in the path of a reeling board driven by the wave and the thousands of pounds per square inch that is possible when waves crash can be lethal. Minimizing board stall, accordingly, has many advantages to the rider.

The instant invention assists in steering and maneuvering water craft with increased effectiveness in both slow and mushy waves as well as in steep an fast ones. Various types of water craft in need of steering mechanisms can benefit from the device of the instant invention. Surfboard and wind surfboards benefit the most and so those types of water planing devices will be the focus of this disclosure. The benefits are realized, however, in many of the otherwise mentioned planing devices.

The ability of prior art mechanisms to overcome or minimize forces creating drag and stall are sufficient, but they miss out on potential benefits in many circumstances.

The problem with some prior art designs is the drag involved with the shaft, which is difficult to overcome. Bolen has several patents (U.S. Pat. Nos. 6,106,346, 6,379,204, 6,767,266, 6,217,402) utilizing a fin that has planar elements on top of and on the bottom of a cylindrical fin. These planar elements serve to increase drag and reduces lift. The instant invention removes the problematic elements of these inventions to provide for improved performance. U.S. Pat. No. 6,089,935 to Fleming III does not have a cylindrical mounting surface that is found in the instant design, i.e., there is no top to the fin. Fleming discloses a cylindrical bottom which is the point that actually adds drag. The instant invention contains the majority of the surface focused where the board meets the fin. U.S. Pat. No. 6,955,577 suffers from similar limitations found in Fleming. U.S. Pat. No. 3,103,673 to Martin has a planar element and uses a tilt that is downward at the fore and aft angles toward the ski. This creates significant drag and holds the ski down in the water. The instant invention operates to create lift and angles the cylinder in the opposite direction from Martin. U.S. Pat. No. 3,089,157 to May suffers from similar limitations described herein. The object of the instant invention is to provide a water planing device that reduces drag and increases lift, something that all of the prior art has failed to do.

To a large extent, the designs of steering mechanisms for water craft have not evolved much. Standard fin designs utilize a dorsal-type fin, which primarily works with the agency of propulsion referred to as drift. To understand, one can visualize a tuna swimming and using its tail fin for thrust or propulsion (back and forth motion). A tuna uses its dorsal and pectoral fins to control vertical and horizontal steering, while mainly using its tail for propulsion. Standard surfboard steering is achieved through a dorsal style fin or fins and vertically oriented tail fins. These surfboard fins offer very little in terms of positive effects on lift. Furthermore, their rigid straight line construction with its perpendicular orientation to the board actually is a hindrance to some aspects of performance. This hindrance appears in its effect on draft, stall and low-lift.

It is the object of the instant invention to provide an improved device to place on the bottom surface of water planing devices in order to overcome the shortcomings of the prior art. The instant invention provides lift and reduced stall by approximately mimicking cetaceans or dolphin and whale tails, or bat rays/manta rays, and bird wings; rather than shark, tuna, or dolphin tail/dorsal fin combinations.

SUMMARY OF THE INVENTION

The basic embodiment of the present invention teaches a device for the stabilization of water planing craft to aid in the maneuvering of said craft on water comprising: a cylindrical body having an outer face and an inner face; a flat base attached to said outer face of said cylindrical body said flat base having a leading edge and a trailing edge wherein said flat base is attachable to the bottom of said water planing craft.

The above embodiment can be further modified by defining that said cylindrical body is a closed loop.

The above embodiment can be further modified by defining that said cylindrical body is not a closed loop, but that terminates in a first edge and a second edge wherein said first and second edges approach each other but leave a space gap therebetween.

The above embodiment can be further modified by defining that said leading edge and said trailing edge of said flat base are angled away from said bottom of said water planing craft.

The above embodiment can be further modified by defining that said leading edge and said trailing edge of said flat base are along the same plane as said bottom of said water planing craft.

An alternate embodiment teaches a method of stabilizing and maneuvering a water planing craft comprising the steps of: attaching an apparatus to the bottom of said water planing craft, said apparatus further comprising: a cylindrical body having an outer face and an inner face; a flat base attached to said outer face of said cylindrical body said flat base having a leading edge and a trailing edge wherein said flat base is attachable to the bottom of said water planing craft; applying force to side water planing craft relative to said apparatus to provide the ability to maneuver and stabilize said water planing craft.

The above embodiment can be further modified by defining that said cylindrical body is a closed loop.

The above embodiment can be further modified by defining that said cylindrical body is not a closed loop, but that terminates in a first edge and a second edge wherein said first and second edges approach each other but leave a space gap therebetween.

The above embodiment can be further modified by defining that said leading edge and said trailing edge of said flat base are angled away from said bottom of said water planing craft.

The above embodiment can be further modified by defining that said leading edge and said trailing edge of said flat base are along the same plane as said bottom of said water planing craft.

The above embodiment can be further modified by defining that more than one device is attached to said bottom of said water planing craft.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1B:
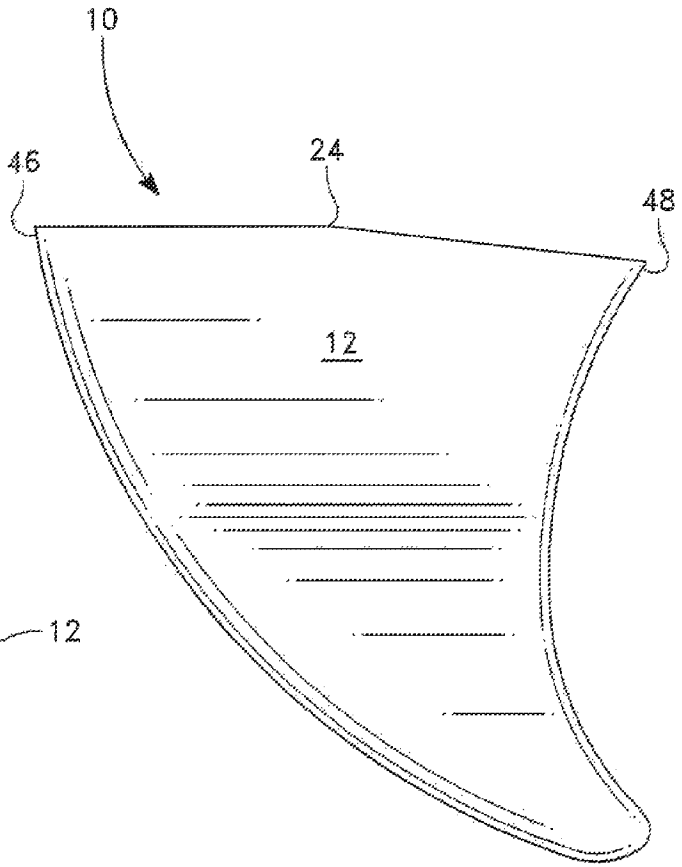
FIG. 1B is a side view of the gap embodiment of the device of the instant invention as illustrated in FIG. 1A.

Turning to the drawings, the preferred embodiment is illustrated and described by reference characters that denote similar elements throughout the several views of the instant invention.

The device 10 of the instant invention is used to assist the steering of water craft or water planing apparatus. The device 10 can include a gap between the two tips 18, 20 of the device 10, but in a second embodiment the device 30 also works with a configuration where the tip has a solid connection. The device 10 consists of one solid piece of material with various attributes that can be altered to achieve a variety of desired effects. There will be various embodiments of the device that will have different attributes depending on the desired placement of them on the water craft (See FIGS. 5-7E). Some water craft could have one single steering device (FIGS. 5-7B) and some could have multiple devices (FIGS. 7C-7E).

Figure 1A:
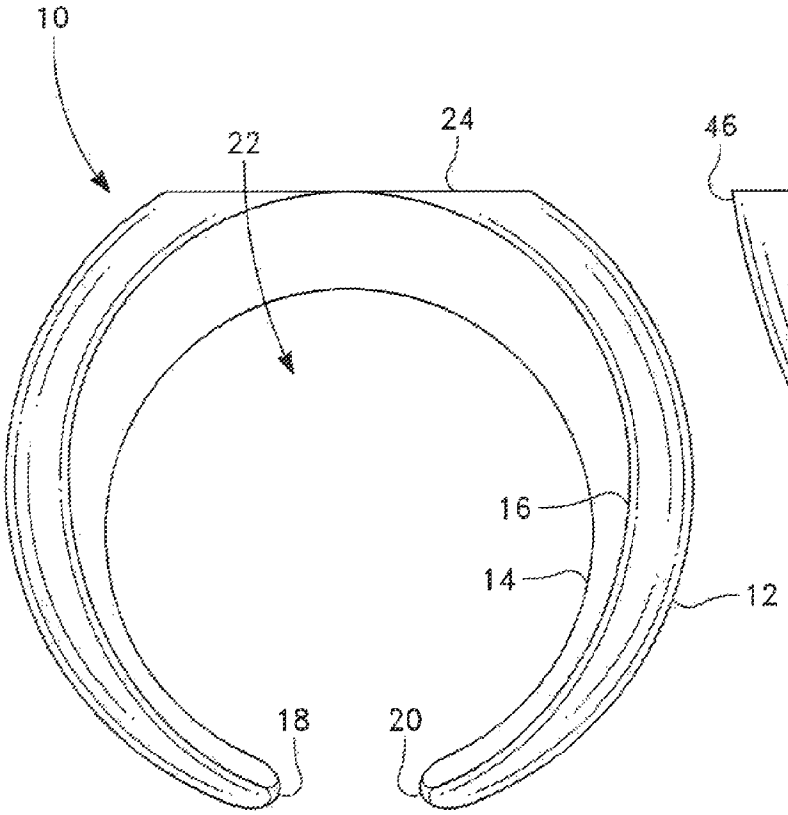
FIG. 1A is a front view of the gap embodiment of the device of the instant invention.
Figure 4:
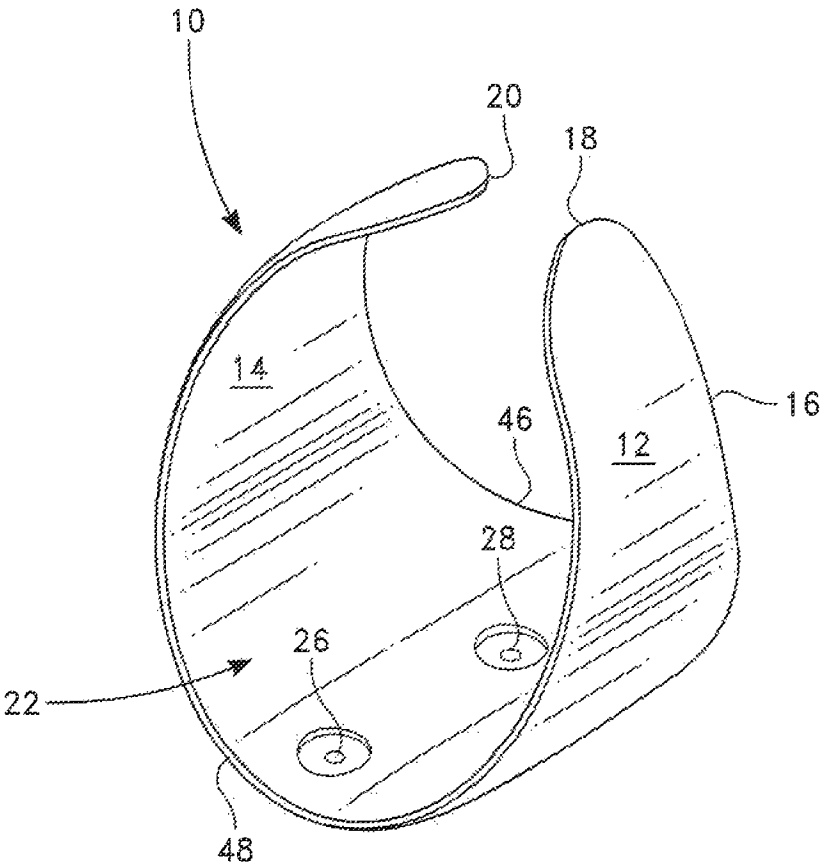
FIG. 4 is a second side perspective view of the gap embodiment of the device of the instant invention.

We turn first to the preferred embodiment which is the device 10 illustrated in FIGS. 1A, 1B and 4. The base of the device 10 has a flat plane 24 which enables it to have a low drag entry point for water to begin to pass through it. This flat plane 24 serves to increase the stability of the mount to the water craft. The flat plane 24 also allows for the aft of the base to drop away from the water craft, enabling a decrease in drag, especially when turning. The flat plane 24 is typically mounted at an angle 66 as shown in FIG. 7B. There are also instances, however, where the entire base of the device 10 will be in contact with the water planing apparatus in order to achieve maximum mounting stability.

The right and left sides of the device 10 could be mirror images of each other in terms of their thickness, length and height, circumference, radius, fore, aft and outline. The right and left sides of the device 10 could also be different from one another, however, in order to achieve particular benefits associated with the water craft shape and size, the device placement on the water craft, as well as the specifics related to the type of water dynamics most important in the given application, the most applicable embodiment will vary depending on the outcomes desired.

The diameter and height of the device 10 will be no less than one inch and can be up to several feet or many feet, depending on the size of the water craft and its intended hydrodynamic conditions. In the preferred embodiment, the device 10 is a continuous curved unit that is shaped to nearly form an enclosed loop 16, but that terminates in two ends 18, 20 prior to the closing the loop. The unit has an outer face 12 and inner face 14, both ending in the separated ends 18, 20. The loop shape 16 of the device 10 leaves an interior hollow space 22 through which water passes as the device 10 moves through water.

At the base or top of the device 10 is the mounting portion defined as the flat plane 24. The flat plane 24 is mounted to the bottom of a water craft through one or more attachment apertures 26, 28 found thereon or any other suitable attachment means. A side view of the preferred embodiment is shown in FIG. 1B where it can be seen that the leading edge 46 of the flat portion 24 and the trailing edge 48 of the flat portion are angled. This angle can be adjusted as desired for the specific water craft and water conditions.

Figure 2B:
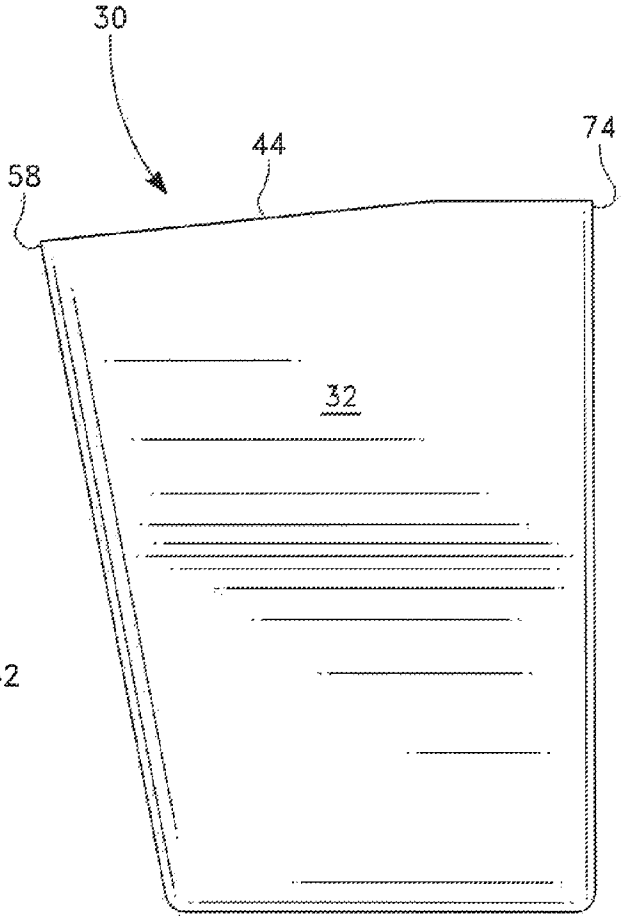
FIG. 2B is a side vies of the closed circumferential embodiment of the device of the instant invention as illustrated in FIG. 2A.
Figure 2A:
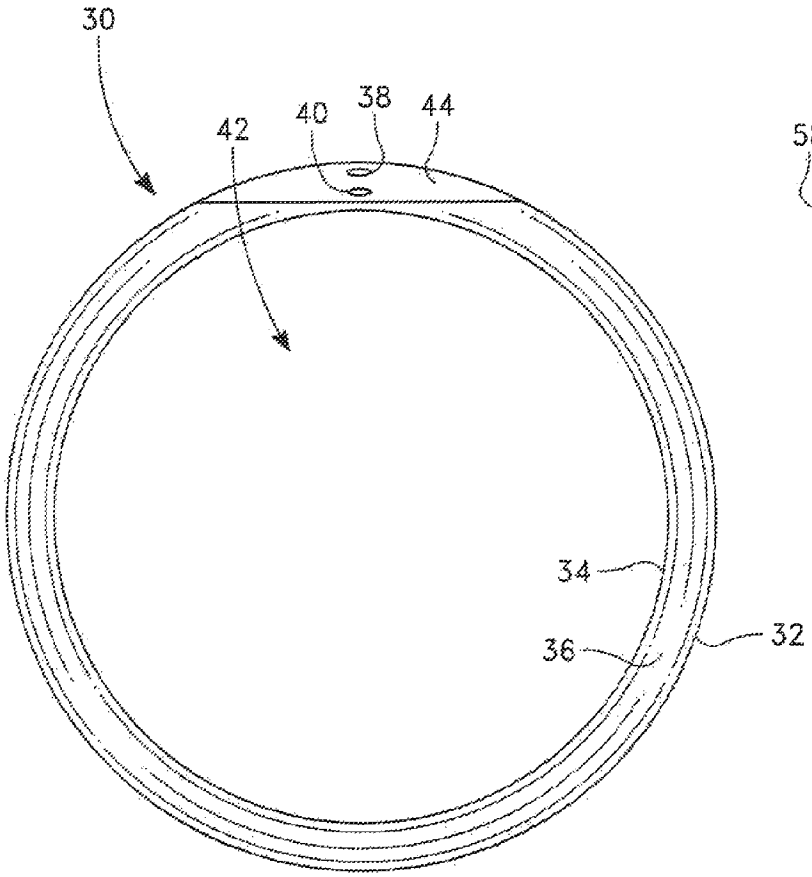
FIG. 2A is a front view of the closed circumferential embodiment of the device of the instant invention.
Figure 3:
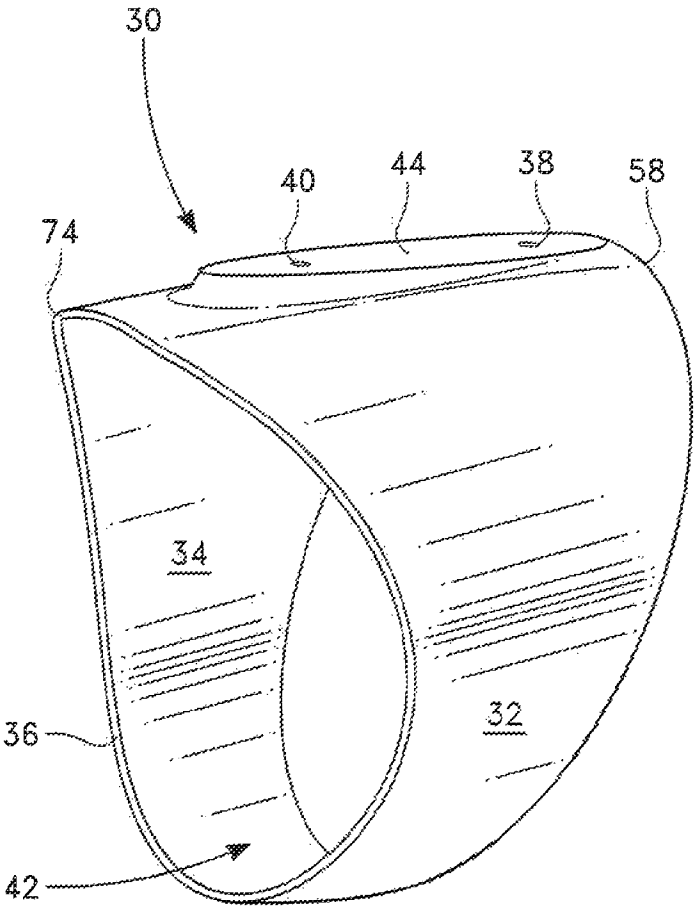
FIG. 3 is first side perspective view of the closed circumferential embodiment of the device of the instant invention.

An alternate embodiment is shown in detail in FIGS. 2A-3 and on water craft in FIGS. 5-6C and FIGS. 7A, 7C-7E. The alternate embodiment is a closed circumference device 30 without a gap. The loop 36 is closed and like the preferred embodiment has an outer face 32 and an inner face 34. There is also a flat plane 44 surface for attachment to the bottom of the water craft. The flat plane 44 has one or more apertures 38, 40 for attachment to the bottom of the water craft or any other suitable attachment means. An open space 42 is created through which water passes through while in use.

Figure 5:
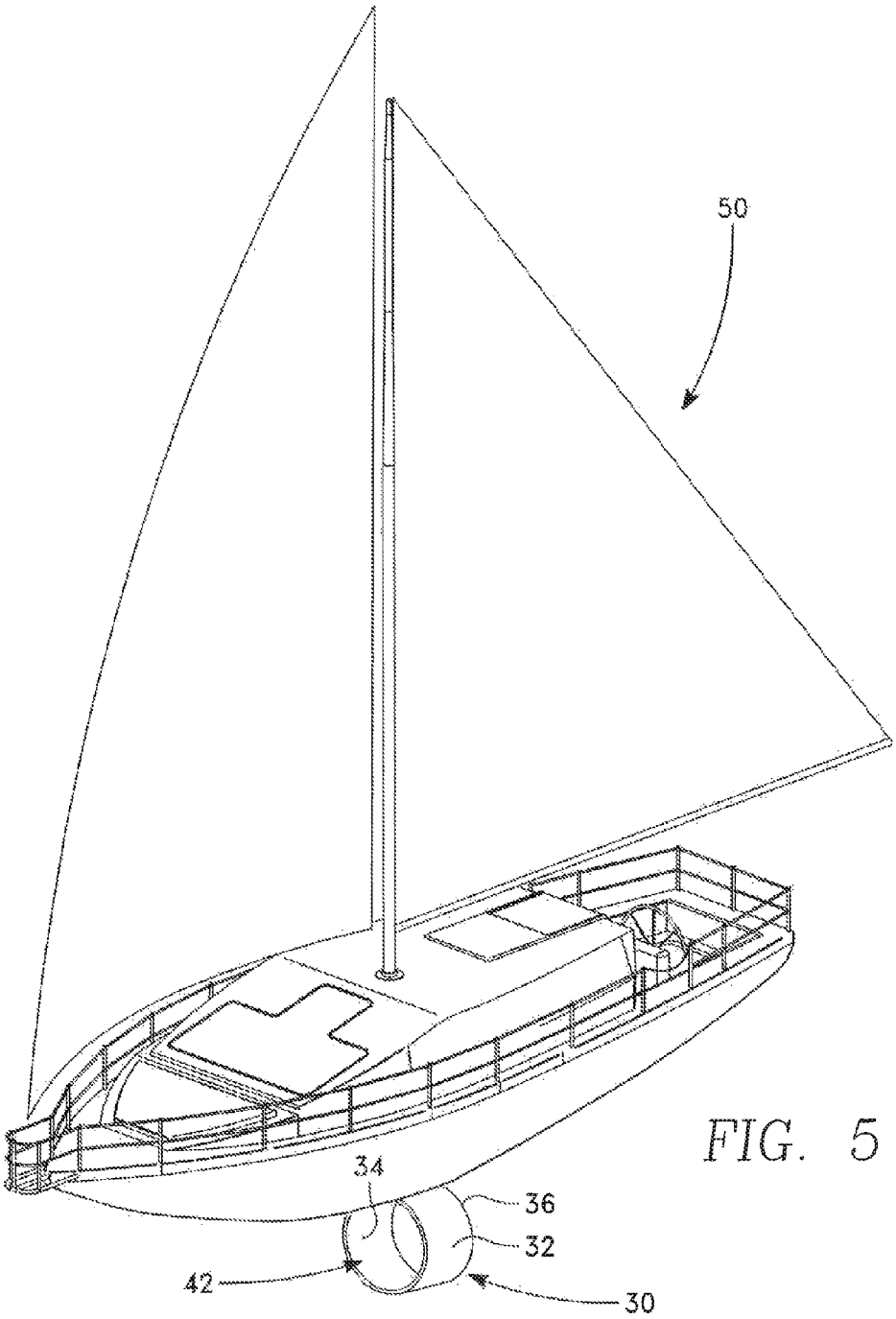
FIG. 5 is a perspective view of a sail boat with the closed circumferential embodiment of the instant invention affixed to the bottom thereof.
Figure 6A:
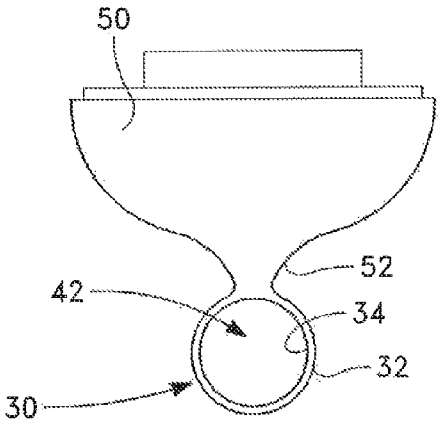
FIG. 6A is a front view of a closed circumferential embodiment of the instant invention in a first mounting position to the bottom of a water planing device.
Figure 6B:
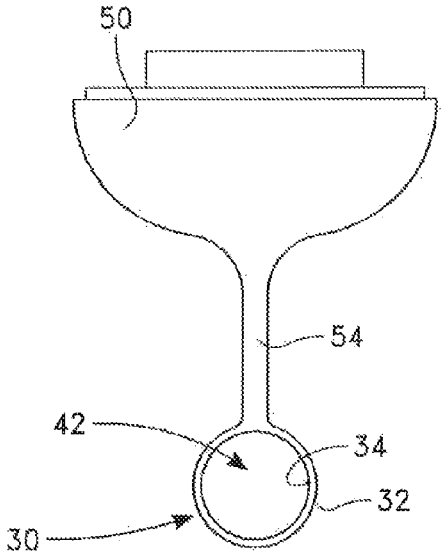
FIG. 6B is a front view of a closed circumferential embodiment of the instant invention in a second mounting position to the bottom of a water planing device.
Figure 6C:
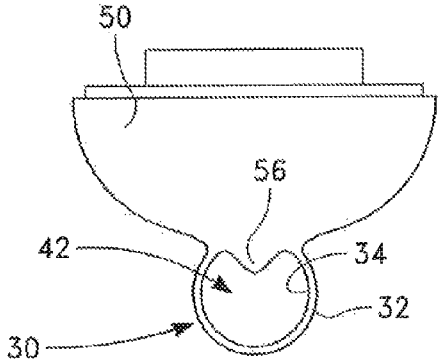
FIG. 6C is a front view of a close circumferential embodiment of the instant invention in a third mounting position to the bottom of a water planing device.
Figure 6D:
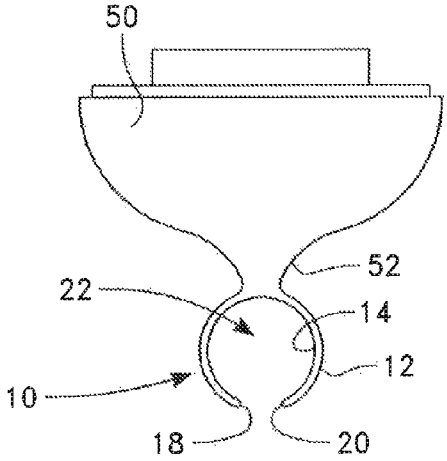
FIG. 6D is a front view of a gap embodiment of the instant invention in a mouting position to the bottom of a water planing device similar to FIG. 6A.

FIGS. 5-7E show the two embodiments in various combinations on various types of water craft. FIG. 5 shows the alternate embodiment device 30 attached to the center bottom of a sailboat 50. FIGS. 6A-6D show both the alternate embodiment 30 (FIGS. 6A-6C) and the preferred embodiment 10 (FIG. 6D) attached to various types of hydrofoils on the bottom of a water craft. FIG. 6A shows the device 30 attached at a specific point 52 on the bottom of the craft 50. FIG. 6B shows the device 30 attached to an extended hydrofoil 54 on the bottom of the sailboat 50. FIG. 6C shows yet another hydrofoil configuration 56 to which the device 30 is attached. FIG. 6D shows the preferred embodiment 10 attached to a similar arrangement as seen in FIG. 6A. The shape can be oval or egg-shaped as well (not shown).

Figure 7A:
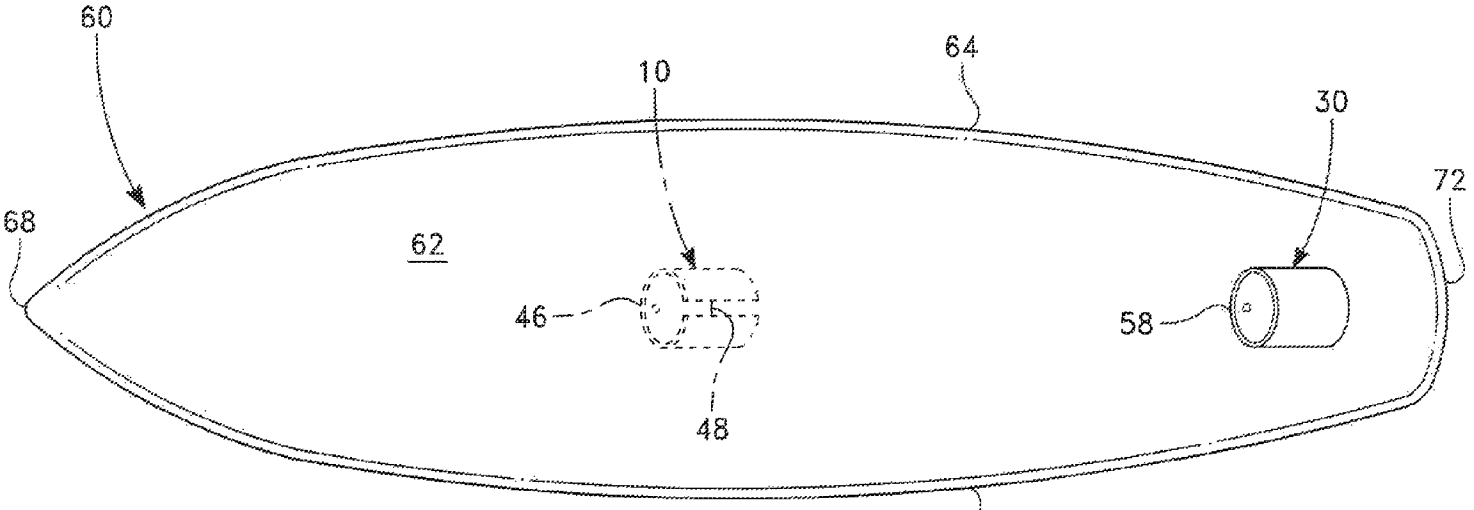
FIG. 7A is the bottom view of a surfboard with a closed circumferential embodiment of the instant invention attached to the bottom thereof near the tail of the board, while another gap embodiment version is shown in phantom near the center of the bottom of the surfboard.
Figure 7B:
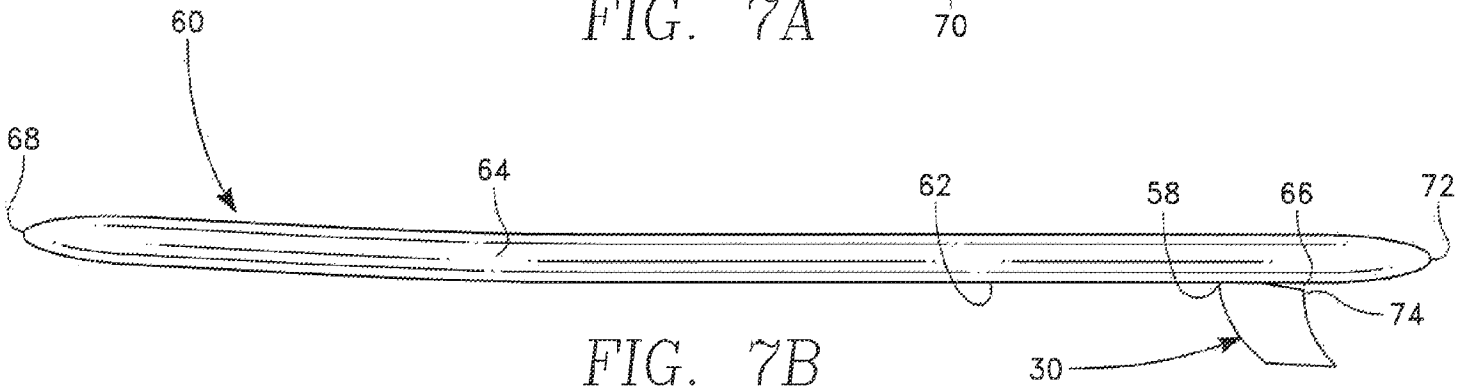
FIG. 7B is a side view of the FIG. 7A.
Figure 7E:
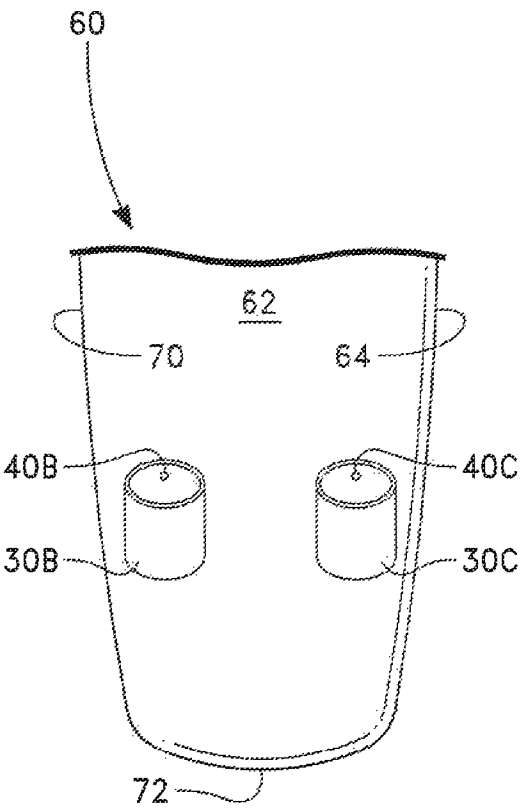
FIG. 7E shows a third array of multiple devices placed near the tail of the bottom of a surfboard wherein two devices of substantially the same diameter are placed in a parallel line relative to the tail of the board.
Figure 7D:
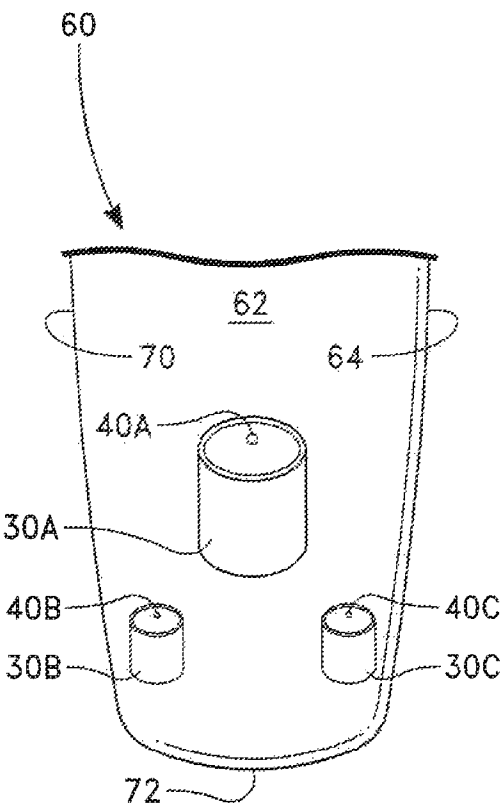
FIG. 7D shows a second array of multiple devices placed near the tail of the bottom of a surfboard wherein a larger diameter device is distal the tail and two smaller diameter devices are proximate the tail.
Figure 7C:
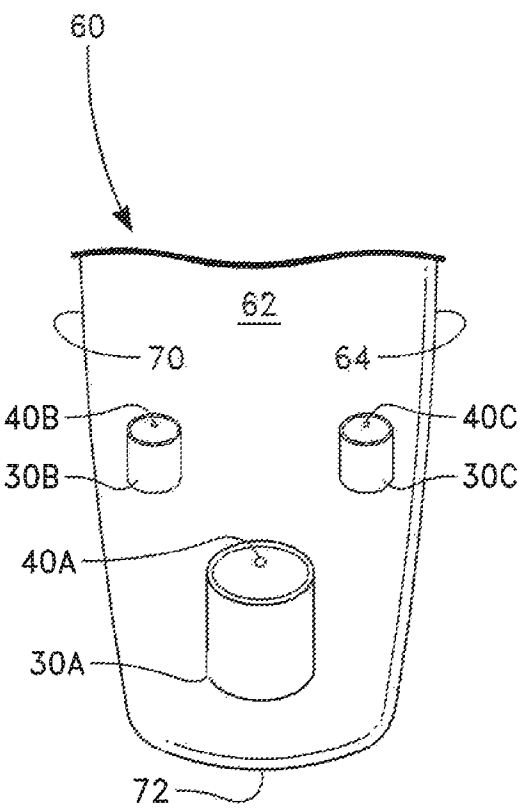
FIG. 7C shows a first array of multiple devices placed near the tail on the bottom of a surfboard wherein a larger diameter device is proximate the tail and two smaller diameter devices are distal the tail.

FIGS. 7A-7E illustrate various placements on the bottom of a surfboard 60. The primary part of the surfboard 60 for purposes of discussing this invention is the bottom 62 of the board. The surfboard includes as sides a first rail 64 and a second rail 70. The front of the surfboard is typically referred to as the nose 68 and the rear as the tail 72. As seen in FIG. 7A, either embodiment can be placed nearly anywhere on the bottom 62 of the surfboard 60. As illustrated the alternate embodiment 30 is shown as a solo device near the tail 72 while the preferred embodiment 10 is shown in phantom near the center. Viewed from the side in FIG. 7B it can be seen that the device 30 is mounted such that the flat plane is mounted at an angle 66 with the trailing edge 74 being lower relative to the bottom of the board 62 than the leading edge 58.

In FIGS. 7C-7E three different possible arrays of various size fins and fin placements are shown. These illustrations are by no means exhaustive and are shown for illustration purposes only. In FIG. 7C one large device 30A is place proximate the tail 72 and mounted thereon 40A, while two smaller diameter devices 30B, 30C are placed more distal the tail 72 and closer to the rails 64, 70 and mounted thereon 40B, 40C. At least two mounting holes are required on each fin. In FIG. 7D this arrangement is reversed in that the larger diameter device 30A is distal the tail 72 while the smaller diameter devices 30B, 30C are proximate the tail 72. Finally, FIG. 7E shows just two equal diameter devices 30B located in a parallel plane and near the rails 64, 70.

A sail boat 50 may utilize a closed style shaped device 30 with a diameter upwards of a meter and thickness matching strength, weight and NACA foil to the needs of a larger vessel and sailing propulsion styles.

The thickness of the walls of the device will vary depending on the desired foil, which is closely related to the NACA defined benefits and desired outcomes of particular foil styles, the substrate used to create the device and the stressors that the device is intended to withstand.

The side profile outline of the fore and aft of the device may be more curvilinear or more in a straight line. The curvilinear embodiments tend to deliver less drag and stall in turning or where swift directional changes are desired. The curvilinear outline embodiments tend to offer less lift and less drive. The straight line embodiments tend to deliver more lift and more drive and tend not to offer less drag and less stall.

The substrates used to create some embodiments of the device will range from fiberglass, carbon fiber, C10 and Kevlar, to various epoxy, urethane, polypropylene, polyester or polystyrene compositions and may include wood or various metals, such as anodized aluminum, hardened aluminum alloy, lead, stainless steel and other industry standard material types.

The tip of the device can be a continuous circumference or contain a cap in the circumference depending on its intended usage and desired effects. For example, a device intended to offer maximum turning ability may have a pointed or slightly rounded embodiment. By way of contrast, a device that is intended to offer maximum lift may have a more straight line embodiment.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A device for the stabilization of water planing craft to aid in the maneuvering of said craft on water comprising:

a cylindrical body having an outer face and an inner face;

a flat base attached to said outer face of said cylindrical body said flat base having a leading edge and a trailing edge wherein said flat base is attachable to the bottom of said water planing craft wherein said cylindrical body is not a closed loop, but that terminates in a first edge and a second edge opposite said flat base wherein said first and second edges approach each other but leave a space gap therebetween.

2. A device for the stabilization of water planing craft to aid in the maneuvering of said craft on water comprising:

a cylindrical body having an outer face and an inner face;

a flat base attached to said outer face of said cylindrical body said flat base having a leading edge and a trailing edge wherein said flat base is attachable to the bottom of said water planing craft wherein said leading edge and said trailing edge of said flat base are angled away from said bottom of said water planing craft.

* * * * *